US008338356B2

(12) United States Patent
Mu et al.

(10) Patent No.: US 8,338,356 B2
(45) Date of Patent: Dec. 25, 2012

(54) SURFACTANT COMPOSITIONS WITH WIDE PH STABILITY

(75) Inventors: Jeff Jianhai Mu, Shanghai (CN); Xiao Hua Wang, Shanghai (CN); Pierre T. Varineau, Lake Jackson, TX (US); Kirk R. Thompson, Lake Jackson, TX (US)

(73) Assignee: Dow Global Technologies LLC, Midland, MI (US)

( * ) Notice: Subject to any disclaimer, the term of this patent is extended or adjusted under 35 U.S.C. 154(b) by 0 days.

(21) Appl. No.: 13/139,529

(22) PCT Filed: Dec. 25, 2008

(86) PCT No.: PCT/CN2008/073716

§ 371 (c)(1),
(2), (4) Date: Jun. 14, 2011

(87) PCT Pub. No.: WO2010/072029

PCT Pub. Date: Jul. 1, 2010

(65) Prior Publication Data

US 2011/0245131 A1 Oct. 6, 2011

(51) Int. Cl.

| | |
|---|---|
| ***C11D 1/722*** | (2006.01) |
| ***C11D 1/02*** | (2006.01) |
| ***C11D 1/83*** | (2006.01) |
| ***B08B 3/04*** | (2006.01) |

(52) U.S. Cl. ..... 510/421; 510/340; 510/351; 510/356; 510/357; 510/360; 510/426; 510/475; 510/492; 510/505; 510/524; 510/535; 8/137

(58) Field of Classification Search ..... 510/340, 510/351, 356, 357, 360, 421, 426, 475, 492, 510/505, 524, 535; 8/137

See application file for complete search history.

(56) References Cited

U.S. PATENT DOCUMENTS

| | | | | |
|---|---|---|---|---|
| 4,715,991 | A | | 12/1987 | Hirakouchi et al. |
| 5,273,677 | A | * | 12/1993 | Arif ..... 510/514 |
| 5,527,362 | A | | 6/1996 | Cole et al. |
| 5,661,121 | A | | 8/1997 | Dahlgren et al. |
| 5,721,759 | A | | 2/1998 | Raatikainen |
| 6,429,342 | B1 | | 8/2002 | Clement et al. |
| 6,602,823 | B1 | | 8/2003 | Rochling et al. |
| 6,743,764 | B1 | | 6/2004 | Wallick et al. |
| 6,764,762 | B2 | | 7/2004 | Seemuth et al. |
| 7,371,716 | B2 | | 5/2008 | Ruland et al. |
| 7,501,390 | B2 | | 3/2009 | Yagi et al. |
| 2005/0170991 | A1 | | 8/2005 | Ruland et al. |
| 2006/0148664 | A1 | | 7/2006 | Bergstrom |

FOREIGN PATENT DOCUMENTS

| | | | | |
|---|---|---|---|---|
| CN | 101113569 | A | | 1/2008 |
| EP | 0845449 | A1 | | 6/1998 |
| GB | 2432585 | A | | 5/2007 |
| JP | 1112594 | | | 5/1989 |
| WO | 9400508 | A1 | | 1/1994 |
| WO | 9410278 | A1 | | 5/1994 |
| WO | WO 94/10278 | | * | 5/1994 |
| WO | 2006009203 | A1 | | 1/2006 |
| WO | WO 2006/131689 | | * | 12/2006 |
| WO | 2008088647 | A1 | | 7/2008 |
| WO | 2008125143 | A1 | | 10/2008 |
| WO | WO 2009/155187 | | * | 12/2009 |

OTHER PUBLICATIONS

Guo et al., "Calculation of hydrophile-lipophile balance for polyethoxylated surfactants by group contribution method", Journal of Colloid and Interface Science 298, 2006, pp. 441-450, Elsevier.

* cited by examiner

*Primary Examiner* — Brian P Mruk

(57) ABSTRACT

Provided is a surfactant composition having wide pH stability. The composition is useful for various applications, including textile processing. The composition comprises: a nonionic surfactant of formula (I): $R^1$—O—[$(CH_2CH(R^2)$—$O)_x(CH_2CH_2O)_y]_z$—H, wherein $R^1$, $R^2$, x, y, and z are defined herein, together with an anionic surfactant.

14 Claims, No Drawings

SURFACTANT COMPOSITIONS WITH WIDE PH STABILITY

CROSS REFERENCE TO RELATED APPLICATIONS

This is a §371 application of PCT International Patent Application Number PCT/CN2008/073716 filed Dec. 25, 2008, which is incorporated herein by reference in its entirety.

FIELD OF THE INVENTION

The invention relates to surfactant compositions. The compositions are stable over a wide pH range and show good cleaning efficiency in alkaline solution. The compositions are useful in various applications, including textile processing.

BACKGROUND OF THE INVENTION

Textile materials are produced from fibers (finite lengths) and filaments (continuous lengths) by a variety of processes to form woven, knitted and nonwoven fabrics, which can be used in household textiles and a variety of industrial applications. There are a number of wet processing steps, such as scouring, dyeing/printing, and finishing in the production of textile materials. Surfactants are commonly used in the processing steps to provide various functions including, for instance, softening, defoaming, and cleaning.

To be effective, the surfactants for use in textile production should exhibit certain characteristics, such as, wetting/penetrating performance; low foaming behavior, particularly in textile dyeing and printing steps; cleaning efficiency; and easy handling, such as being of low pour point, non-gelling, and fast dissolving.

The scouring process in textile production refers to the removal of sizing materials, lubricants and other impurities which are contained in and/or adhere to the fibers during their formation. These various impurities must be removed so that the textile fibers may be further processed. Scouring is performed under extremely alkaline conditions using high concentration of caustic soda, and at high temperatures. Surfactants for use in the scouring step, therefore, should exhibit alkaline stability. Surfactants that exhibit alkaline stability would help the textile manufacturer minimize the numbers and types of surfactant they need to stock.

While alkylphenol ethoxylates (APEs) are widely recognized as good surfactants in a broad variety of applications, they do suffer from a poor public perception of their environmental compatibility. Previously contemplated APE-replacement surfactants, however, generally may have good performance profiles in a select few applications, but not in other applications. In addition, the replacements may be biodegradable, but not environmentally acceptable, or vice versa, or they may not be stable in strongly alkaline environments.

Thus, next generation surfactants for textile processing should be stable over a wide pH range, should exhibit a favorable environmental profile, and should be broadly useable, including in the various steps involved in textile processing.

BRIEF SUMMARY OF THE INVENTION

In one aspect, the invention provides a surfactant composition. The composition comprises:

(a) a nonionic surfactant represented by formula (I):

$$R^1—O—[(CH_2CH(R^2)—O)_x(CH_2CH_2O)_y]_z—H \quad (I)$$

wherein $R^1$, $R^2$, x, y, and z are as defined herein; and (b) an anionic surfactant.

In another aspect, the invention provides a method for cleaning or scouring a textile material, the method comprising applying to the material a surfactant composition as described herein.

DETAILED DESCRIPTION OF THE INVENTION

As noted above, one aspect of the invention is the provision of a surfactant composition. The composition is a mixture of a nonionic surfactant of formula (I) and an anionic surfactant.

The compositions of the invention exhibit several desirable properties. For example, the compositions are stable in high pH solutions when compared to other surfactants, and exhibit greater capillary effect, therefore providing better cleaning efficiency. The compositions also, in general, show good wetting properties. They further provide low foaming behavior, particularly in textile dyeing and printing steps, eco-friendly attributes which can reduce the cost of water treatment, and low pour point, non-gelling, and fast-dissolving qualities, thus increasing their ease of handling. In addition, the compositions are APE-free.

The formula (I) nonionic surfactant component of the invention composition is of the following chemical structure:

$$R^1—O—[(CH_2CH(R^2)—O)_x(CH_2CH_2O)_y]_z—H \quad (I)$$

wherein x is, independently at each occurrence, 0 or a real number from about 1 to about 11, provided that, in at least one occurrence, x is greater than 0; y is, independently at each occurrence, 0, or a real number from about 1 to about 20, provided that, in at least one occurrence, y is greater than 0; z is a whole number between 1 and 50; $R^1$ is a $C_{6-18}$ branched or linear alkyl; and $R^2$ is, independently at each occurrence, $CH_3$ or $CH_2CH_3$.

It is understood that "x" and "y" represent average degrees of, respectively, propoxylation and/or butoxylation (depending on the identity of $R^2$) and ethoxylation. Thus, x and y need not be whole numbers, which is intended to be illustrated by use of "about." Taken together, x and y establish a degree of alkoxylation in an oligomer distribution. It is to be understood that the order of x and y is block or random, with x being the first and/or last block. Preferably, the PO or BO portion, and EO portion are the result of a block feed.

Likewise, "z" is a whole number, as it represents the number of iterations of the formula. For example, for a $PO_x$-$EO_y$-$BO_x$ oligomer, z would be 2 and the second y would be zero. For a $EO_y$-$BO_x$-$PO_x$-oligomer, z would be 3, with the first x and the second and third y is zero.

$R^1$ is a branched or linear alkyl that results when the corresponding linear or branched alcohol compound is alkoxylated. Methods for making the nonionic surfactants of the invention by the alkoxylation of alcohols are discussed below. $R^1$ can be any $C_{6-18}$ branched or linear alkyl.

In one embodiment, $R^2$ is $CH_3$, thus representing a propylene oxide. In other embodiments, $R^2$ is $CH_2CH_3$, thus representing a butylene oxide.

In one embodiment, the HLB value of the formula (I) nonionic surfactant is between about 8 and 15, as calculated using methods described in "Calculation of Hydrophile-Lipophile balance for polyethoxylated surfactants by group contribution method," Xiaowen Guo; Zongming Rong; Xugen Ying; Journal of Colloid and Interface Science 298 (2006) 441-450.

In one embodiment, the nonionic surfactant is represented by formula (II):

$$R^1—O—(CH_2CH(R^2)—O)_x(CH_2CH_2O)_y—H \quad (II)$$

wherein $R^1$, x, and y are as defined above.

Preferred nonionic surfactants of formula (II) include compounds in which x is a real number from about 1 to about 11; y is a real number from about 1 to about 20; $R^1$ is a $C_{6-10}$ branched or linear alkyl; and $R^2$ is $CH_3$ or $CH_2CH_3$. Compounds of this paragraph are referred to as having formula (II-1).

Preferred surfactants of formula (II-1) also include compounds in which x is about 4, 5, or 6, most preferably about 5.

Preferred surfactants of formula (II-1) further include compounds in which y is about 3, 6, 9, or 11, most preferably about 6.

In a preferred embodiment according to formula (II-1), $R^1$ is a $C_6$-$C_{10}$ branched alkyl, more preferably a $C_{8-9}$ branched alkyl. In one embodiment, $R^1$ is 2-ethylhexyl or 2-propylhexyl, preferably 2-ethylhexyl.

In one embodiment of formula (II-1), $R^1$ is derived from alcohols that are produced from internal octenes. "Internal octenes" refers to the unreacted residual, or byproduct, left behind when reacting ethylene with 1-octene to produce ethylene/1-octene copolymers ("EOC's"). These internal octenes can be obtained as a purge stream from the process, and then can be converted to alcohols by a process which will be described hereinafter. Alcohols produced from internal octenes include at least one of 1-nonanol, 2-methyl-1-octanol, 2-ethyl-1-septanol, 2-propyl-1-hexanol, 3-methyl-4-hydroxymethyl septane, 3-methyl-3-hydroxymethyl-septane, or 2-hydroxymethyl-3-methyl septane. Normally, the alcohols will be a blend when produced, however, either blends or single alcohols may be used for making the formula (II-1) compounds.

Preferred surfactants of Formula (II-1) are also those wherein x is about 4, 5, or 6; y is about 3, 6, 9, or 11; $R^1$ is a $C_{8-9}$ branched alkyl, and $R^2$ is $CH_3$. Most preferred surfactants of Formula (II-1) are those wherein x is 5; y is 6; $R^1$ is 2-ethylhexyl, and $R^2$ is $CH_3$.

Preferred nonionic surfactants of formula (II) also include compounds in which x is a real number within a range of from 0.5 to less than 4, y is a real number within a range of from 2 to 10, and $R^1$ is a mixture of seed-oil based linear alkyl moieties with an alkyl moiety distribution as follows wherein each wt % is based upon weight of all alkyl moieties present in the distribution and all wt % for each distribution total 100 wt %:

| Carbon Atoms in Alkyl Moiety | Amount |
|---|---|
| $C_6$ | 0 wt %-40 wt % |
| $C_8$ | 20 wt %-40 wt % |
| $C_{10}$ | 20 wt %-45 wt % |
| $C_{12}$ | 10 wt %-45 wt % |
| $C_{14}$ | 0 wt %-40 wt % |
| $C_{16}$-$C_{18}$ | 0 wt %-15 wt %. |

Surfactants of this embodiment are referred to as having formula (II-2).

Preferred surfactants according to formula (II-2) include compounds wherein x is a real number less than or equal to 3.

Preferred surfactants according to formula (II-2) include compounds wherein x is a real number within a range of from 2-3.

Preferred surfactants according to formula (II-2) include compounds wherein x is less than y.

Preferred surfactants according to formula (II-2) include compounds wherein y is greater than or equal to 2 times x.

Preferred surfactants according to formula (II-2) include compounds wherein x is from 2.5 to 3, and the alkyl moiety is as follows:

| Carbon Atoms in Alkyl Moiety | Amount |
|---|---|
| $C_6$ | 0-36% |
| $C_8$ | 22-40% |
| $C_{10}$ | 27-44% |
| $C_{12}$ | 14-35% |
| $C_{14}$ | 5-13% |
| $C_{16}$-$C_{18}$ | 0-5% |

Preferred surfactants according to formula (II-2) include compounds wherein y is 3, 5, or 7.

Surfactants of formula (II-2) and methods for their preparation are described in copending international application publication number WO 2008/088647, which is incorporated herein by reference. Some surfactants of formula (II-2) are also commercially available from The Dow Chemical Company, under the trade name Ecosurf™ SA.

Various of the nonionic surfactants of formula (I) are considered biodegradable, according to certain standard screening tests. A global standard screening test for the aerobic biodegradation of surfactants is based on the Organization for Economic Cooperation and Development (OECD) 301 28-day modified Sturm test, which gives results as "readily biodegradable" (>=60% biodegradation) "inherently biodegradable" (>=20% but less than 60%) or "non biodegradable" (<20%). For global regulatory compliance, it is broadly perceived that any new surfactants developed and commercialized should meet the "readily biodegradable" classification using the OECD 301 series aerobic tests. As demonstrated by the Examples below, various nonionic surfactants of formula (I) are readily biodegradable according to the OECD 301 testing methodology (defined by greater than 60% biodegradation).

In addition to meeting the status of "readily biodegradable," surfactants should desirably also have an acceptable aquatic toxicity. Readily biodegradable surfactants which have an aquatic toxicity of greater than 10 milligrams per liter, meet the "Design for the Environment" (DfE) Screen for Surfactants in Cleaning Products. Various nonionic surfactants of formula (I) exhibit an aquatic toxicity of greater than 10 mg/L as shown in the Examples.

The nonionic surfactants of formula (I) may be prepared through the conversion of alcohols to alcohol alkoxylates by methods such as those discussed in "Nonionic Surfactants," Martin, J. Schick, Editor, 1967, Marcel Dekker, Inc., or United States Patent Application Publication (USPAP) 2005/0170991A1 which is incorporated herein by reference in its entirety. Fatty acid alcohols may also be alkoxylated using metal cyanide catalysts including (but not limited to) those described in U.S. Pat. No. 6,429,342 and references cited therein.

Alkoxylation processes may be carried out in the presence of acidic or alkaline catalysts. It is preferred to use alkaline catalysts, such as hydroxides or alcoholates of sodium or potassium, including NaOH, KOH, sodium methoxide, potassium methoxide, sodium ethoxide and potassium ethoxide. Base catalysts are normally used in a concentration of from 0.05 percent to about 5 percent by weight, preferably about 0.1 percent to about 1 percent by weight based on starting material. In one non-limiting embodiment, a C8 olefin mixture is first converted to an alcohol as described hereinabove, and subsequently converted to form a nonionic surfactant via alkoxylation with from greater than about 2 to about 5 moles of propylene oxide and from greater than about 1 to about 10 moles of ethylene oxide.

The addition of alkylene oxides may, in one non-limiting embodiment, be carried out in an autoclave under pressures from about 10 psig to about 200 psig, preferably from about 60 to about 100 psig. The temperature of alkoxylation may range from about 30° C. to about 200° C., preferably from about 100° C. to about 160° C. After completion of oxide feeds, the product is typically allowed to react until the residual oxide is less than about 10 ppm. After cooling the reactor to an appropriate temperature ranging from about 20° C. to 130° C., the residual catalyst may be left unneutralized, or neutralized with organic acids, such as acetic, propionic, or citric acid. Alternatively, the product may be neutralized with inorganic acids, such as phosphoric acid or carbon dioxide. Residual catalyst may also be removed using ion exchange or an adsorption media, such as diatomaceous earth.

The second component of the composition of the invention is an anionic surfactant. Suitable anionic surfactants include: alpha olefin sulfonates (AOS), fatty acid methyl ester sulfonates (MES), alcohol ether carboxylates (AEC), alkyl sulfates or sulfonates (AS), alkyl ether sulfates (AES), linear alkylbenzene sulfonates (LAS), phosphate esters, sulfosuccinates, disulfates and disulfonates, sodium xylene sulfonate, or monoglyceride (ether) sulfates, or mixtures thereof.

A preferred class of anionic surfactants is the type derived from alkyl diphenyl oxide sulfonic acids and their salts. Examples include the monoalkyl diphenyl oxide disulfonates, the monoalkyl diphenyl oxide monosulfonates, the dialkyl diphenyl oxide monosulfonates, and the dialkyl diphenyl oxide disulfonates, and their mixtures.

Particularly preferred are anionic surfactants of formula (III):

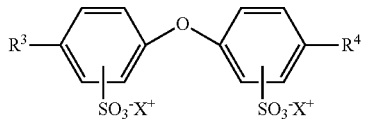

(III)

wherein $R^3$ and $R^4$ are, independently at each occurrence, hydrogen, linear or branched $C_1$-$C_{16}$ alkyl, or aryl; and X is independently hydrogen, sodium or potassium.

Surfactants of formula (III) contain a pair of sulfonate groups on a diphenyl oxide backbone. The two sulfonates provide double charge density to the molecule. The double charge provides a more powerful, more durable, and more versatile surfactant molecule when compared to single charge anionics. This higher local charge density results in greater potential for solvating and coupling action. In addition, the flexible ether linkage of the molecule allows variable distance between the sulfonates, allowing interactions with a broad variety of other materials in solution as well as excellent coupling with other surfactants and ingredients.

In one embodiment, one or both of $R^3$ and $R^4$ are preferably independently linear or branched $C_3$-$C_{16}$ alkyl, preferably $C_6$-$C_{16}$ alkyl.

In one embodiment, X at each occurrence is preferably sodium.

Further preferred alkyl diphenyl oxide sulfonic acid based anionic surfactants include: disodium hexadecyldiphenyloxide disulfonate; disodium dihexadecyldiphenyloxide disulfonate; sodium dipropyldiphenyleneoxide sulfonate, disodium didecyldiphenylene oxide disulfonate, and disodium mono- and di-sec-hexyldiphenylene oxide disulfonate, as well as their mixtures. Such materials can be readily prepared by a person of ordinary skill in the art, using well known techniques. Suitable procedures are described in U.S. Pat. No. 6,743,764, and references cited therein, which is incorporated herein by reference. Various of the foregoing materials are also commercially available under the DOWFAX™ trademark (from The Dow Chemical Company).

The relative amounts of nonionic surfactant and anionic surfactant in the composition are not critical. In one embodiment, a suitable amount of nonionic surfactant is between about 10% and about 95%, more preferably between about 20% and about 80%, and even more preferably between about 50% and about 80%, by weight based on the total weight of nonionic formula (I) surfactant and anionic surfactant in the composition.

The composition may further include additional additives such as water, co-surfactants, amine oxides, alkyl amine oxides, solvents, chelating agents, bases such as monoethanolamine, diethanolamine, triethanolamine, potassium hydroxide, sodium hydroxide, or other bases, and other conventional formulation ingredients. In some embodiments, water is a preferred optional additive. Preferably, an amount of up to about 40%, more preferably up to 30%, and even more preferably up to 25%, by weight, based on the total weight of water, formula (I) nonionic surfactant, and anionic surfactant, is used.

A particularly preferred surfactant composition according to the invention comprises: a nonionic surfactant of formula (II-1) in which $R^1$ is branched $C_8$ alkyl, x is about 5 and y is about 6; and an anionic surfactant comprising a mixture of disodium hexadecyldiphenyloxide disulfonate and disodium dihexadecyldiphenyloxide disulfonate. Preferably $R^1$ is 2-ethylhexyl. Also preferably, the HLB level of the composition is between about 9 and about 11.5.

Another particularly preferred surfactant composition according to the invention comprises: a nonionic surfactant of formula (II-1) in which $R^1$ is branched $C_8$ alkyl, x is about 5 and y is about 6; and an anionic surfactant comprising sodium benzeneoxy-bispropylenesulfonate. Preferably $R^1$ is 2-ethylhexyl. Also preferably, the nonionic surfactant comprises at least about 50% by weight, relative to the total weight of nonionic and anionic surfactants. Additionally preferably, the HLB level of the composition is between about 9 and about 11.5.

A further preferred surfactant composition according to the invention comprises: a nonionic surfactant of formula (II-2) in which $R^1$ is linear $C_8$-$C_{16}$ alkyl, x is about 2.5 and y is 3, 5, or 7; and an anionic surfactant comprising a mixture of disodium hexadecyl-diphenyloxide disulfonate and disodium dihexadecyldiphenyloxide disulfonate.

The composition of the invention may be used in formulations and compositions in any desired amount. However, it is commonly known to those skilled in the art that levels of surfactant compositions in many conventional applications may range from about 0.05 to about 90 weight percent, more frequently from about 0.1 to about 30 weight percent, and in some uses from about 0.5 to about 20 weight percent, based on the total formulation. Those skilled in the art will be able to determine usage amounts via a combination of general knowledge of the applicable field as well as routine experimentation where needed. Although the compositions of the invention are particularly well suited for use in textile processing, their pH stability and other attributes make them suitable for use in a variety of other formulations including, but not limited, to kitchen cleaners, cleaners for triglycerides, cross-linked triglycerides, or mixtures thereof, cleaners for mineral-oil type soils, hydrotropes for formula stabilization, surfactant for ultra-concentrate formulas, self-hydrotroping surfactants for enhanced formula stabilization with surfactant activity, general cleaners, pre-wash spotting agents, pre-wash concentrates, detergents, hard surface cleaning formulations.

In further embodiments, the compositions of the invention find use in polyurethanes, epoxies, thermoplastics, paints, emulsions for paints and coatings, such as poly(acrylates), coatings, metal products, agricultural products including herbicides and pesticides, mining products, pulp and paper products, textiles, water treatment products, flooring products, inks, colorants, pharmaceuticals, personal care products, lubricants, and a combinations of these.

In preparing these and other types of formulations and products, the compositions of the invention may contribute to or enhance a desirable property, such as surfactancy, detergency, wetting, re-wetting, foam reduction, additive stabilization, latex stabilization, as an intermediate in reactions involving ester formation or urethane formation, drug delivery capability, emulsification, rinsing, plasticization, reactive dilution, rheology modification, suspension, pseudoplasticization, thickening, curing, impact modification, lubrication, emulsification and micro-emulsification, a combination thereof, or the like.

Examples of these applications include utility of compositions of the invention as surfactants for household and commercial cleaning; as surfactants for the cleaning of triglyceride or cross-linked triglyceride soils, as hydrotropes for enhancing formula stability, as self-hydrotroping surfactants to eliminate or reduce hydrotropes from formulas, pre-wash spotters, laundry, ultra-concentrated laundry formulations ultraconcentrated hard-surface cleaning formulations, ultra-concentrated dilutable surfactants, as surfactants for imparting freeze-thaw stability in paints and coatings, as surfactants for imparting freeze-thaw stability for pigment dispersion, as surfactants in mechanical cleaning processes, as surfactants for use in cleaning kitchens or industrial kitchens, as surfactants for cleaning areas with cross-linked triglycerides such as grills, kitchen ware, stoves, and walls, as reactive diluents in casting, encapsulation, flooring, potting, adhesives, laminates, reinforced plastics, and filament windings; as coatings; as wetting agents; as rinse aids; as defoam/low foam agents; as spray cleaning agents; as emulsifiers for herbicides and pesticides; as metal cleaning agents; as suspension aids and emulsifiers for paints and coatings; as mixing enhancers in preparing microheterogeneous mixtures of organic compounds in polar and non-polar carrier fluids for agricultural spread and crop growth agents; as surfactants for agricultural adjuvants, as stabilizing agents for latexes; as microemulsifiers for pulp and paper products; and the like. In one non-limiting embodiment, compositions of the invention may include microemulsions used for organic synthesis and/or cleaning, formation of inorganic and organic particles, polymerization, and bio-organic processing and synthesis, as well as combinations thereof. In other non-limiting embodiments, the alkoxylates described herein may serve to dilute higher viscosity epoxy resins based on, for example, bisphenol-A, bisphenol-F, and novolak, as well as other thermoplastic and thermoset polymers, such as polyurethanes and acrylics. They may also find use in rheology modification of liquid systems such as inks, emulsions, paints, and pigment suspensions, where they may also be used to impart, for example, enhanced biodegradability, pseudoplasticity or thixotropic flow behavior. In these and other uses the compositions of the invention may offer good and, in some cases, excellent performance, as well as relatively low cost.

"Alkyl," as used in this specification, encompasses straight or branched chain alkyl groups having the indicated number of carbon atoms.

An "aryl" group is a C6-C12 aromatic moiety comprising one to three aromatic rings. Preferably, the aryl group is a C6-C10 aryl group. A preferred aryl group is phenyl.

The following examples are illustrative of the invention but are not intended to limit its scope.

EXAMPLES

Example

Biodegradability and Aquatic Toxicity of the Nonionic Surfactant Component of the Invention Compositions The biodegradability of the formula (I) nonionic surfactant components of the invention are tested by exposing the alkoxylates to microorganisms derived from activated sludge obtained from a municipal sewage treatment plant under aerobic static exposure conditions, using standard OECD 301 F methodology. OECD 301 F refers to the Organization for Economic Cooperation and Development Guidelines for the Testing of Chemicals, "Ready Biodegradability: Manometric Respirometry Test," Procedure 301 F, adopted 17 Jul. 1992, which is incorporated herein by reference in its entirety.

Study procedures and test methods for determining aquatic toxicity are based on the recommendations of the following guidelines:

Organization for Economic Cooperation and Development (OECD): OECD Guidelines for the Testing of Chemicals, "Freshwater Alga and Cyanobacteria, Growth Inhibition Test", Procedure 201, adopted 23 Mar. 2006; European Economic Community (EEC): Commission directive 92/69/EEC of 31 Jul. 1992, Methods for the determination of ecotoxicity, C.3, "Algal Inhibition Test".

OECD Guidelines for the Testing of Chemicals, "Freshwater Alga and Cyanobacteria, Growth Inhibition Test", Procedure 201, adopted 23 Mar. 2006; European Economic Community (EEC): Commission directive 92/69/EEC of 31 Jul. 1992, Methods for the determination of ecotoxicity, C.3, "Algal Inhibition Test".

Data from the biodegradation and aquatic toxicity tests of the formula (I) component of the invention composition is shown in Table 1. The data indicate that the tested formula (I) materials are readily biodegradable according to the OECD 301 testing methodology (defined by greater than 60% biodegradation).

TABLE 1

| Compound | OECD 301F Biodegradation, % | Fresh Water algal growth inhibition test with *Desmondesmus subspicatus* ErC50/0-3 | 48-hour Acute Toxicity to *Daphna magna* (EC50-50 hour) |
|---|---|---|---|
| $R^1$(PO)5(EO)3* | 74 | 31.9 mg/L | 33.6 mg/L |
| $R^1$(PO)5(EO)9* | 79 | 97.7 mg/L | >100 mg/L |
| C9(BO)1(EO)7 | 73 | 21 | 6.2 |
| C9(PO)4(EO)8 | 70 | 26 | 29.2 |

*$R^1$ = 2-ethylhexyl.

Examples

Testing of the Surfactant Composition

A. Testing Protocols

Tests applied in this example and their protocols are as follows.

(1) Determination of Wetting Properties by Immersion

Test samples of raw cotton are immersed in a surfactant solution which gradually suppresses the air inside of the fabric and penetrates it until the fabric starts sinking. Wetting time is the time from the immersion until the sinking of the fabric in the solution containing surfactants and other ingredients, such as the base. The test is carried out at room temperature (25±1° C.) using a method based on China Industry Standard HB/T 2575-1994 (Surface active agents—Determination of wetting power by immersion). The test method involves the following steps:

a) Preparation of cotton sailcloth fabric piece: the standard cotton sailcloth fabric is cut to circular pieces with a diameter of 35 mm and weight of about 0.38-0.39 g for further use.

b) Preparation of surfactant solutions: prepare surfactant solutions with or without a certain concentration of caustic soda using distilled water. The surfactant concentration is based on the test conditions, typically 0.1%, 0.5%, and 1.0% by weight. Put the surfactant solutions, 200 ml, in 250 ml beaker, and remove the foam in the solution for further use.

c) Evaluation of wetting ability: place the fabric piece in the surface center point of the surfactant solution, starting the stopwatch at the moment of placement. The solution will penetrate into the fabric piece gradually. Stop the stopwatch when the fabric piece begins to sink in the surfactant solution and record the time. The measured time is referred to as wetting time.

The test for each surfactant composition under examination is repeated 5 times if the value remains the same. In case of greater deviations (approx. 30 seconds) it is repeated 10 times. In case of turbid solutions no values are measured.

(2) Alkaline Tolerance

This test method determines surfactant stability in the presence of varying amounts of sodium hydroxide in solution. The following test protocol is used.

Prepare 20 g/L, 40 g/L, 60 g/L, 80 g/L, and 100 g/L NaOH solution containing 1.0% by weight of the surfactant being tested, and then allow the solution to stand at room temperature for 24 hours without stirring. Check the appearance of the solution at room temperature 20-25° C. Record the NaOH concentration that makes the surfactant solution become turbid from clear.

(3) Capillary Effect

Capillary effect is an indicator of the cleaning efficiency of a surfactant on a tested material. In this test, cotton knitting fabric, 10 g, is treated with the pretreatment formulation shown in Table 2. The treatment is conducted at 95° C. for 45 min with the bath ratio of 20:1 (i.e., 10 g cotton knitting fabric in 200 g of the pretreatment formulation solution), and then rinsing the cotton fabric with 90° C. tap water, 60° C. tap water and then room temperature tap water. Dry the fabric in an oven at 80° C. for 4 hours, and then store fabric at room temperature for further use.

The treated cotton fabric is cut into a shape of 2 cm wide and 21 cm long, and placed in a capillary effect tester (Model YG(B) 871, made by China Wenzhou Darong Textile Instrument Co., Ltd.), and a certain amount of water placed in the tester. The water will climb up through the cotton fabric. The height that the water climbs up in the fabric in 5 minutes is recorded. Greater height indicates better wetting efficiency of the surfactant on the cotton fabric.

TABLE 2

| Fabric pretreatment formulation | |
|---|---|
| Ingredients | Dosage (g/L) |
| NaOH | 2.0 |
| $H_2O_2$ (35%) | 2.5 |
| Surfactant Composition | 1.5 |
| $Na_2SiO_3$ | 0.5 |
| STPP | 0.5 |

TABLE 2-continued

| Fabric pretreatment formulation | |
|---|---|
| Ingredients | Dosage (g/L) |
| $NaHSO_3$ | 0.5 |
| Water | balance |

B. Results

The following surfactants are used in the examples below.

DOWFAX™ 8390. An anionic surfactant containing disodium hexadecyldiphenyloxide disulfonate and disodium dihexadecyldiphenyloxide disulfonate.

DOWFAX™ 2A1. An anionic surfactant containing sodium benzeneoxybispropylenesulfonate.

DOWFAX™ 3B2. An anionic surfactant containing benzenesulfonic acid, decyl(sulfophenoxy)-, disodium salt and benzenesulfonic acid, oxybis(decyl)-, disodium salt DOWFAX™ C6L. An anionic surfactant containing benzene, 1,1'-oxybis-, sec-hexyl derivatives.

DOWFAX™ C10L. An anionic surfactant containing benzenesulfonic acid, decyl(sulfophenoxy)-, disodium salt and benzenesulfonic acid, oxybis(decyl)-, disodium salt.

Nonionic A. A nonionic surfactant of formula (II-1) in which: $R^1$ is 2-ethylhexyl ($CH_3CH_2CH_2CH_2CH(CH_2CH_3)CH_2$—); $R^2$ is $CH_3$; x is 5; and y is 3.

Nonionic B. A nonionic surfactant of formula (II-1) in which: $R^1$ is 2-ethylhexyl; $R^2$ is $CH_3$; x is 5; and y is 6.

Nonionic C. A nonionic surfactant of formula (II-1) in which: $R^1$ is 2-ethylhexyl; $R^2$ is $CH_3$; x is 5; and y is 9.

Nonionic D. A nonionic surfactant of formula (II-2) in which: $R^1$ is linear $C_8$-$C_{16}$ alkyl, x is 2-3 and y is 3-4.

Nonionic E. A nonionic surfactant of formula (II-2) in which: $R^1$ is linear $C_8$-$C_{16}$ alkyl, x is 2-3 and y is 5-6.

Nonionic F. A nonionic surfactant of formula (II-2) in which: $R^1$ is linear $C_8$-$C_{16}$ alkyl, x is 2-3 and y is 7-8.

Lutensol® XL-50. A nonionic surfactant produced by BASF, which is an ethoxylate product based on the C10 Guerbet alcohol.

Lutensol® XP-90. A nonionic surfactant produced by BASF, which is an alkoxylate product based on the C10 Guerbet alcohol.

Softanol® 70. A nonionic surfactant produced by Nippon Shokubai, which is an ethoxylate product based on C12-C14 secondary alcohol.

C10-16(EO)5. A nonionic surfactant with 5 moles ethylene oxide group based on C10-C16 linear fatty alcohol.

C10-16(EO)7. A nonionic surfactant with 7 moles ethylene oxide group based on C10-C16 linear fatty alcohol.

NPE-6. A nonionic surfactant with 6 moles of ethylene oxide group, based on nonylphenol.

NPE-9. A nonionic surfactant with 9 moles ethylene oxide group, based on nonylphenol.

Surfactants and mixtures used in some of the examples are shown in Table 3.

TABLE 3

| Surfactant composition examples | | | | | |
|---|---|---|---|---|---|
| | Surfactant Mixture (wt %) | | | | |
| Examples | Non-ionic A | Non-ionic B | Non-ionic C | DOWFAX ™ 2A1 | DOWFAX ™ 8390 |
| Ex. 1 (comparative) | 100.0 | 0 | 0 | 0 | 0 |
| Ex. 2 (comparative) | 0 | 100.0 | 0 | 0 | 0 |

TABLE 3-continued

| Surfactant composition examples | | | | | |
|---|---|---|---|---|---|
| | Surfactant Mixture (wt %) | | | | |
| Examples | Non-ionic A | Non-ionic B | Non-ionic C | DOWFAX ™ 2A1 | DOWFAX ™ 8390 |
| Ex. 3 (comparative) | 0 | 0 | 100.0 | 0 | 0 |
| Ex. 4 | 0 | 80.0 | 0 | 20.0 | 0 |
| Ex. 5 | 0 | 50.5 | 21.6 | 27.9 | 0 |
| Ex. 6 | 0 | 20.0 | 30.0 | 50.0 | 0 |
| Ex. 7 | 19.8 | 50.5 | 0 | 29.7 | 0 |
| Ex. 8 | 30.0 | 20.0 | 0 | 0 | 50.0 |
| Ex. 9 | 10.0 | 80.0 | 0 | 10.0 | 0 |
| Ex. 10 | 21.6 | 50.5 | 0 | 27.9 | 0 |
| Ex. 11 | 0 | 49.5 | 40.0 | 10.5 | 0 |
| Ex. 12 | 0 | 27.5 | 40.0 | 0 | 32.5 |
| Ex. 13 | 40.0 | 20.0 | 0 | 40.0 | 0 |
| Ex. 14 | 0 | 79.0 | 0 | 0 | 21.0 |
| Ex. 15 | 40.0 | 50.0 | 0 | 0 | 10.0 |
| Ex. 16 | 0 | 50.0 | 0 | 0 | 50.0 |
| Ex. 17 | 0 | 80.0 | 10.0 | 0 | 10.0 |

Table 4 shows wetting property and alkaline tolerance results for the various surfactants and mixtures from Table 3 as well as other commercial surfactants.

TABLE 4

| Wetting property and alkaline tolerance ability for surfactants | | | | | | |
|---|---|---|---|---|---|---|
| | | Wetting | Alkaline | Wetting Time (s), 1.0% surfactant | | |
| Examples | HLB | Time (s), 0.50% | Tolerance (g/L), 1% | 20 g/L NaOH | 40 g/L NaOH | 60 g/L NaOH |
| Ex. 1 (comparative) | 7.9 | 5 | <20 | Turbid | Turbid | Turbid |
| Ex. 2 (comparative) | 10.6 | 1 | ~20 | 1 | Turbid | Turbid |
| Ex. 3 (comparative) | 12.5 | 3 | ~40 | 1 | 1 | Turbid |
| Ex. 4 | 10.5 | 3 | 20~40 | 1 | Turbid | Turbid |
| Ex. 5 | 10.9 | 5 | 40~60 | 1 | 1 | Turbid |
| Ex. 6 | 11 | 20 | 60~80 | 10 | 3 | 2 |
| Ex. 7 | 9.9 | 3 | ~40 | 1 | 1 | Turbid |
| Ex. 8 | 7.8 | 11 | 20~40 | 4 | Turbid | Turbid |
| Ex. 9 | 10.3 | 2 | 40~60 | 1 | 1 | Turbid |
| Ex. 10 | 9.9 | 3 | 20~40 | 2 | Turbid | Turbid |
| Ex. 11 | 11.3 | 3 | 40~60 | 1 | 1 | Turbid |
| Ex. 12 | 10 | 25 | ~60 | 8 | 2 | Turbid |
| Ex. 13 | 9.3 | 3 | 20~40 | 1 | Turbid | Turbid |
| Ex. 14 | 9.7 | 4 | 20~40 | 1 | Turbid | Turbid |
| Ex. 15 | 9.1 | 2 | <20 | 2 | Turbid | Turbid |
| Ex. 16 | 8.6 | 29 | 40~60 | 14 | 5 | Turbid |
| Ex. 17 | 9.7 | 2 | 20~40 | 2 | Turbid | Turbid |
| Lutensol ® -50 (comparative) | | 2 | <20 | Turbid | Turbid | Turbid |
| Softanol ® 70 (comparative) | | 6 | 20~40 | 1 | Turbid | Turbid |
| NPE-9 (comparative) | | 4 | 20~40 | 4 | Turbid | Turbid |
| C10-16(EO)5 (comparative) | | 17 | <20 | Turbid | Turbid | Turbid |
| C10-16(EO)7 (comparative) | | 20 | ~40 | 7 | 9 | Turbid |

From the data in Tables 3 and 4, it can be seen that the inclusion of the anionic surfactant (DOWFAX™) with the nonionic surfactant, according to the compositions of the invention, improves the alkaline tolerance of the resultant mixture. Thus, overall, the anionic surfactant improves the alkaline tolerance ability of the surfactant mixture from about 20 g/L to about 80 g/L. For example, the alkaline tolerance for nonionic B (Ex. 2) is only about 20 g/L, but most of inventive surfactant mixture examples tested containing Nonionic B and anionic surfactants have an alkaline tolerance of about 20 to about 80 g/L.

In addition, for the inventive surfactant mixtures containing 1% mixture in 20 g/L NaOH solution, most examples show better wetting performance than the solutions without NaOH, and some examples have excellent wetting property (~1 s) when containing 20 g/L NaOH, including Exs. 4, 5, 7, 9, 11, 13, 14. Furthermore, some inventive surfactant mixtures containing 1% mixture in 40 g/L NaOH solution, also show excellent wetting performance, including Exs. 5, 6, 7, 9, 11, 12, 16. Ex. 6 shows outstanding wetting properties in a 60 g/L NaOH solution.

In Table 6, the capillary effect of surfactant compositions of the invention is compared to the capillary effect of non-inventive surfactants. It can be seen that the surfactant mixture containing nonionic surfactants of formula (I) together with anionic surfactants (DOWFAX™) overall show better capillary effect than that of individual surfactants, indicating greater cleaning efficiency of the surfactant mixture of the invention.

TABLE 6

| Capillary Effect | | |
|---|---|---|
| Samples | Ratio | Capillary Effect (cm/5 min) |
| Ex. 1 (Nonionic A) (comparative) | | 3.2 |
| Ex. 2 (Nonionic B) (comparative) | | 8.8 |
| Ex. 3 (Nonionic C) (comparative) | | 11.5 |
| DOWFAX ™ 8390 + Nonionic B | 1:1 | 12.3 |
| DOWFAX ™ 8390 + Nonionic A + Nonionic C | 1:1:1 | 12.4 |
| DOWFAX ™ 8390 + Nonionic B + Nonionic C | 1:1:1 | 12.4 |
| Nonionic D (comparative) | | 8.3 |
| Nonionic E (comparative) | | 10.8 |
| Nonionic F (comparative) | | 11.3 |
| DOWFAX ™ 8390 + Nonionic E | 1:1 | 12.2 |
| DOWFAX ™ 8390 + Nonionic D + Nonionic F | 1:1:1 | 12.3 |
| NPE-6 (comparative) | | 8.7 |
| NPE-9 (comparative) | | 11.2 |
| Softanol ® 70 (comparative) | | 10.9 |
| C10-16(EO)5 (comparative) | | 10.8 |
| C10-16(EO)7 (comparative) | | 11.1 |
| Lutensol ® XL-50 (comparative) | | 9.2 |
| Lutensol ® XP-90 (comparative) | | 11.8 |

While the invention has been described above according to its preferred embodiments, it can be modified within the spirit and scope of this disclosure. This application is therefore intended to cover any variations, uses, or adaptations of the invention using the general principles disclosed herein. Further, the application is intended to cover such departures from the present disclosure as come within the known or customary practice in the art to which this invention pertains and which fall within the limits of the following claims.

The invention claimed is:

1. A composition comprising:

(a) a nonionic surfactant represented by formula (II):

$$R^1—O—(CH_2CH(R^2)—O)_x(CH_2CH_2O)_y—H \quad (II)$$

wherein x is a real number within a range of from 0.5 to less than 4;

y is a real number within a range of from 2 to 10; and $R^2$ is, independently at each occurrence, $CH_3$ or $CH_2CH_3$; and $R^1$ is a mixture of seed-oil based linear alkyl moieties with an alkyl moiety distribution as follows wherein each wt % is based upon weight of all alkyl moieties present in the distribution and all wt % for each distribution total 100 wt %:

| Carbon Atoms in Alkyl Moiety | Amount |
|---|---|
| $C_6$ | 0 wt %-40 wt % |
| $C_8$ | 20 wt %-40 wt % |
| $C_{10}$ | 20 wt %-45 wt % |
| $C_{12}$ | 10 wt %-45 wt % |
| $C_{14}$ | 0 wt %-40 wt % |
| $C_{16}$-$C_{18}$ | 0 wt %-15 wt %; |

and (b) an anionic surfactant.

2. The composition of claim 1 wherein x is a real number less than or equal to 3.

3. The composition of claim 1 wherein the alkyl moiety is as follows:

| Carbon Atoms in Alkyl Moiety | Amount |
|---|---|
| $C_6$ | 0-36% |
| $C_8$ | 22-40% |
| $C_{10}$ | 27-44% |
| $C_{12}$ | 14-35% |
| $C_{14}$ | 5-13% |
| $C_{16}$-$C_{18}$ | 0-5%. |

4. The composition of claim 1 wherein y is 3, 5, or 7.

5. The composition of claim 1 wherein the anionic surfactant is selected from alpha olefin sulfonates (AOS), fatty acid methyl ester sulfonates (MES), alcohol ether carboxylates (AEC), alkyl sulfates or sulfonates (AS), alkyl ether sulfates (AES), linear alkylbenzene sulfonates (LAS), phosphate esters, sulfosuccinates, disulfates and disulfonates, sodium xylene sulfonate, monoglyceride (ether) sulfates, and mixtures of two or more thereof.

6. The composition of claim 1 wherein the anionic surfactant is derived from alkyl diphenyl oxide sulfonic acids or their salts.

7. The composition of claim 1 wherein the anionic surfactant is a monoalkyl diphenyl oxide disulfonate, a monoalkyl diphenyl oxide monosulfonate, a dialkyl diphenyl oxide monosulfonate, a dialkyl diphenyl oxide disulfonate, or a mixture of two or more thereof.

8. The composition of claim 1 wherein the anionic surfactant is represented by formula (III):

(III)

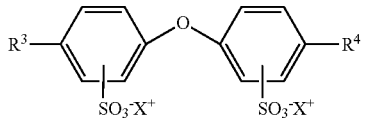

wherein $R^3$ and $R^4$ are, independently at each occurrence, hydrogen, $C_1$-$C_{16}$ alkyl or aryl;

X is independently sodium or potassium.

9. The composition of claim 8 wherein one or both of R3 and R4 are independently H or $C_3$-$C_{16}$ alkyl.

10. The composition of claim 8 wherein X at each occurrence is sodium.

11. The composition of claim 1 wherein the anionic surfactant is disodium hexadecyldiphenyloxide disulfonate; disodium dihexadecyldiphenyloxide disulfonate; sodium dipropyldiphenyleneoxide sulfonate, disodium didecyldiphenylene oxide disulfonate, and disodium mono- and di-sec-hexyldiphenylene oxide disulfonate, or a mixture of two or more thereof.

12. The composition of claim 1 comprising between about 10% and about 95% by weight of the nonionic surfactant, based on the total weight of nonionic surfactant and anionic surfactant in the composition.

13. The composition of claim 1 for use in kitchen cleaners, cleaners for triglycerides, cross-linked triglycerides, or mixtures thereof, cleaners for mineral-oil soils, hydrotropes for formula stabilization, surfactant for ultra-concentrate formulas, self-hydrotroping surfactants for enhanced formula stabilization with surfactant activity, general cleaners, pre-wash spotting agents, pre-wash concentrates, detergents, hard surface cleaning formulations, polyurethanes, epoxies, thermoplastics, paints, emulsions for paints and coatings, such as poly(acrylates), coatings, metal products, agricultural products including herbicides and pesticides, mining products, pulp and paper products, textiles, water treatment products, flooring products, inks, colorants, pharmaceuticals, personal care products, or lubricants.

14. A method for cleaning or scouring a textile material, the method comprising applying the composition of claim 1 to the textile material.

* * * * *